US007814722B2

(12) United States Patent
Perrault et al.

(10) Patent No.: US 7,814,722 B2
(45) Date of Patent: Oct. 19, 2010

(54) ROOF TRUSS

(76) Inventors: Larry Perrault, 4804 - 51 Avenue, Innisfail, Alberta (CA) T0M 1A0; David R. Karroll, 5301 45 Street, Rimbey, Alberta (CA) T0C 2J0

( * ) Notice: Subject to any disclaimer, the term of this patent is extended or adjusted under 35 U.S.C. 154(b) by 0 days.

(21) Appl. No.: 11/927,063

(22) Filed: Oct. 29, 2007

(65) Prior Publication Data

US 2008/0092477 A1 Apr. 24, 2008

Related U.S. Application Data

(63) Continuation of application No. 09/713,296, filed on Nov. 16, 2000, now abandoned.

(30) Foreign Application Priority Data

Nov. 16, 1999 (CA) ..... 2289790

(51) Int. Cl.
*E04B 9/08* (2006.01)
*E04B 9/10* (2006.01)

(52) U.S. Cl. ..... 52/639; 52/93.1; 52/650.3; 52/696; 52/262; 52/702

(58) Field of Classification Search ..... 52/653.1, 52/93.1, 282.3, 282.4, 92.1, 92.2, 262, 272, 52/633, 655.1, 656.9, 656.1, 696, 700, 702, 52/712, 714, 715, 650.3, 693, 481.1, 480, 52/233, 236.7, 285.1
See application file for complete search history.

(56) References Cited

U.S. PATENT DOCUMENTS 533,659 A 2/1895 Meyenberg
872,658 A * 12/1907 Lee ..... 52/92.3
1,369,340 A 2/1921 Hutchinson
1,444,798 A 2/1923 Laughlin
1,821,015 A 9/1931 Hull
1,848,085 A 3/1932 Eisenschmidt
2,354,801 A 8/1944 Huff
2,514,607 A 7/1950 Mclean
3,046,620 A 7/1962 Tvorik et al.
3,298,151 A 1/1967 Juriet
3,336,718 A 8/1967 Cape
3,477,189 A 11/1969 Merson
3,500,597 A * 3/1970 McKenzie ..... 52/92.1
3,531,904 A 10/1970 Sanford
3,668,828 A 6/1972 Nicholas et al.
3,712,004 A * 1/1973 Loebsack ..... 52/265
3,867,803 A 2/1975 Platt
3,969,860 A * 7/1976 Bentley ..... 52/261

(Continued)

FOREIGN PATENT DOCUMENTS

AU 117042 6/1943

(Continued)

*Primary Examiner*—Phi Dieu Tran A
(74) *Attorney, Agent, or Firm*—Stephen M. Nipper; Dykas, Shaver & Nipper, LLP

(57) ABSTRACT

A prefabricated roof truss which includes a bottom plate which attaches to the bottom chord of the roof truss in such a way that the bottom plate does not lift away from the top plate of an interior wall despite the vertical movement of the bottom chord of the roof truss.

4 Claims, 4 Drawing Sheets

U.S. PATENT DOCUMENTS

| | | | | | |
|---|---|---|---|---|---|
| 4,047,352 | A | | 9/1977 | Sweet | |
| 4,073,109 | A | | 2/1978 | Knutson | |
| 4,156,995 | A | | 6/1979 | Zusman | |
| 4,274,241 | A | | 6/1981 | Lindal | |
| 4,479,342 | A | * | 10/1984 | Eberle | 52/741.14 |
| 4,562,683 | A | | 1/1986 | Gottlieb | |
| 4,669,235 | A | | 6/1987 | Reinen | |
| 4,714,372 | A | | 12/1987 | Commins | |
| 4,727,700 | A | | 3/1988 | Eberle | |
| 4,831,807 | A | * | 5/1989 | Bolt | 52/641 |
| 4,873,797 | A | | 10/1989 | Rydeen | |
| 4,920,725 | A | | 5/1990 | Gore | |
| 4,932,173 | A | | 6/1990 | Commins | |
| 4,955,174 | A | | 9/1990 | Valente et al. | |
| 5,384,993 | A | | 1/1995 | Phillips | |
| 5,448,871 | A | | 9/1995 | Newman et al. | |
| 5,459,967 | A | | 10/1995 | Bodtker | |
| 5,497,591 | A | | 3/1996 | Nelson | |
| 5,561,949 | A | | 10/1996 | Knoth | |
| 5,617,693 | A | | 4/1997 | Hefner | |
| 5,640,822 | A | | 6/1997 | Haswell | |
| 5,699,639 | A | | 12/1997 | Fernandez | |
| 5,732,524 | A | | 3/1998 | Kalker et al. | |
| 5,743,063 | A | | 4/1998 | Boozer | |
| 5,799,458 | A | | 9/1998 | Ferguson | |
| 5,870,861 | A | | 2/1999 | Gnaedinger | |
| 6,047,503 | A | | 4/2000 | Kost | |
| 6,094,880 | A | | 8/2000 | Thompson | |
| 6,219,975 | B1 | * | 4/2001 | Olden | 52/92.2 |
| 6,254,306 | B1 | * | 7/2001 | Williams | 403/403 |
| 6,295,781 | B1 | | 10/2001 | Thompson | |
| 6,412,233 | B1 | | 7/2002 | Jones | |

FOREIGN PATENT DOCUMENTS

| | | |
|---|---|---|
| CA | 476296 | 8/1951 |
| DE | 2063138 | 9/1971 |
| DE | 332841 | 9/1983 |
| GB | 552283 | 3/1943 |
| GB | 2138464 | 10/1984 |
| GB | 2185275 | 7/1987 |
| JP | 404049352 | 2/1992 |

* cited by examiner

ROOF TRUSS

CROSS-REFERENCE TO RELATED APPLICATIONS

This application is a continuation of application Ser. No. 09/713,296, filed Nov. 16, 2000, which is pending and incorporated herein by this reference.

FIELD OF THE INVENTION

The present invention provides for an improved roof truss.

BACKGROUND OF THE INVENTION

Prefabricated roof truss systems have been used in construction for a number of years. Roof trusses can be made from wood, wood composites, metal and other materials.

In some situations, vertical arching or deflection of the roof truss occurs. The vertical arching of trusses appears to result from a difference in the temperature that the top and bottom chords are subjected to. In climates where it is necessary to insulate the building for efficient heating or cooling, the ceiling is generally insulated by placing the insulating material between and upon the bottom chords of the roof truss. Therefore the bottom chords are at least partially insulated and can be at a temperature near to that of the interior of the building. The top chords are left uninsulated and are subject to the ambient temperature and humidity. This temperature differential can cause different contraction and expansion of the various parts of the roof truss, resulting in vertical deflection of the roof truss.

Typically, the ceiling finish, usually a sheet material such as gyproc, is directly attached to the underside of the bottom chords of the trusses. A similar finish is typically attached to the interior partition walls. The ceiling finish typically abuts the wall finish. Therefore, if there is vertical arching of the trusses, the ceiling finish is lifted by the bottom chords, and cracks develop between the interior wall finish and the ceiling finish.

Cracking caused by vertical arching of the bottom chords of the trusses can be minimized by stiffening the bottom chord, but this makes the truss much heavier and more difficult to handle during construction and it is not always effective. As well, alternative methods of attaching the edges of the ceiling finish to the walls rather than the ceiling have also been developed. However, these methods require the installation of awkward and complicated fasteners on the construction site, increasing installation time and expense.

Therefore, there is a need in the art for a means of mitigating cracking caused by vertical arching of the bottom chords of trusses.

SUMMARY OF THE INVENTION

A conventional roof truss comprises a top chord, a bottom chord and at least two intermediate members which form triangular shapes in combination with either the bottom chord or the top chord.

This invention is an improvement on roof trusses. It reduces cracking between the ceiling finish and the interior partition wall finish caused by arching of the roof trusses. This is accomplished by means of a bottom plate which is attached to a top plate of the interior partition walls and the roof truss, usually to the bottom chord of the roof truss, in such a way that the bottom plate does not lift away from the top plate of the interior walls despite vertical movement of the bottom chord of the roof truss.

BRIEF DESCRIPTION OF THE DRAWINGS

Embodiments of the invention may now be described with reference to the following Figures.

DETAILED DESCRIPTION OF AN EMBODIMENT(S) OF THE INVENTION

Figure 1:
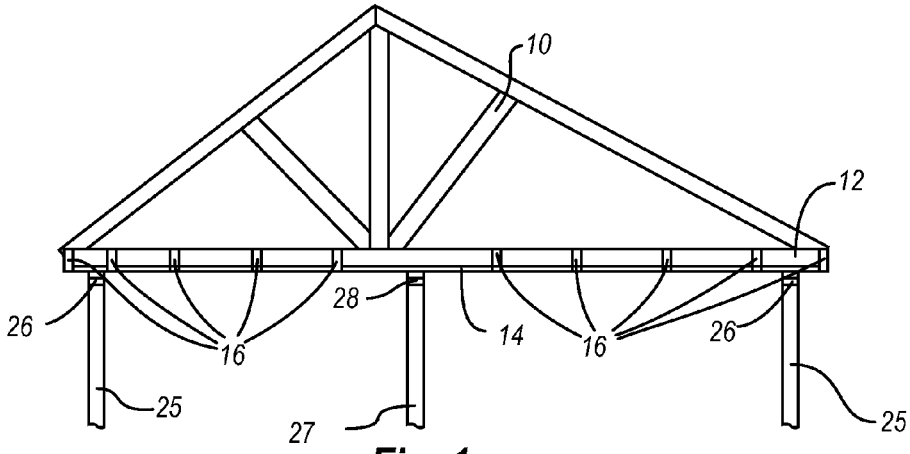
FIG. 1 is a cross sectional elevation view showing the improved roof truss in position upon two exterior walls and a partition wall.

The present invention provides for an improved roof truss. The invention according to the Figures comprises a roof truss (10) wherein a bottom plate (14) is attached to the bottom chord (12) of the roof truss (10) by a plurality of connectors (16).

The bottom plate (14) may be wood, a wood composite, or any other appropriate material. In one embodiment the bottom plate is ¾ inch oriented strand board. In use, the bottom plate is attached to the top plate of the interior partition walls, typically by way of nails, screws, brackets, straps or other appropriate fasteners.

The bottom plate (14) may be attached to the roof truss in many ways. Typically, the bottom plate is suspended from the underside of the bottom chord (12) of the roof truss (10) by a plurality of appropriate connectors (16). The connectors attaching the bottom plate to the bottom chord permit the bottom plate and the ceiling finish to flex to accommodate some vertical movement of the bottom chord. There are two general types of connectors which do this:

a) slidable connectors, which will, under sufficient tension, permit movement of the bottom plate relative to the bottom chord; or b) rigid connectors, which are positioned an appropriate distance from the interior partition wall.

Slidable connectors may be used in conjunction with rigid connectors.

To work properly the rigid connectors must be both sufficiently far from the interior wall to permit flexing of the bottom plate and ceiling finish, and sufficiently close to the interior partition wall to adequately support the bottom plate and ceiling finish. The rigid connectors may include fasteners, gang plates and hangers. The fasteners may include screws, nails, staples or other appropriate fasteners. Gang plates are commonly used in the assembly of wood roof trusses to attach the various pieces of wood together. Gang plates are metal sheets having punched-out, pointed tangs which protrude perpendicularly from one surface. In use, the gang plate is positioned so as to overlap the joint between pieces of wood, and the pointed tangs are forced into the wood, thus securing the pieces of wood together. The hangers may be H-shaped hangers, U-shaped hangers, wrap-around hangers, or other appropriate hangers. The hangers may be metal, plastic or any other suitable material. The hangers are attached to the bottom chord and/or the bottom plate by a plurality of fasteners such as screws, nails, staples or other appropriate fasteners.

In one embodiment the connectors attaching the bottom plate to the roof truss are prepositioned when the roof truss is made. The truss layout technician prepositions the connectors so that they are the proper distance from the interior partition walls. In some circumstances, where the roof truss intersects a closet next to a hallway, prepositioning of the hangers can result in an unsupported span of the bottom plate which could be damaged during the transportation or installation of the roof truss. This risk of damage can be alleviated by temporarily attaching the bottom plate to the bottom chord with tape or plastic strapping.

In another embodiment the connectors are removable and the desired positioning of the connectors is achieved on the construction site by removing those connectors which are too close to the interior partition walls. In another embodiment the connectors are made so that they can be easily cut or broken. For example, the frangible connectors may be hangers having rows of perforations across the hanger which can be broken by prying with the claw of a claw hammer or a pry bar; or by using a hammer and chisel. In use, those frangible connectors which would otherwise be removed are cut or broken.

In another embodiment, the connectors suspending the bottom plate from the roof truss are slidable connectors. The connectors may be made slidable by a variety of means. In one embodiment, the connectors are hangers having vertically slotted holes through which wood fasteners are driven into the roof truss and/or the bottom plate so that when the hanger is attached to the roof truss and/or bottom plate, the hanger can move relative to those wood fasteners passing through the slotted holes. In this way, if the roof truss rises relative to the interior partition wall, the hanger will slide relative to the roof truss and/or the bottom plate so as to permit the bottom plate to stay fixed to the interior partition wall.

In one embodiment the hangers are of an appropriate configuration such that there is a gap between the bottom plate and the bottom chord, which creates a thermal break between the ceiling finish and the bottom chord of the roof truss. This may significantly improve the energy efficiency of the ceiling, particularly where the roof truss is constructed of a heat conducting material such as steel and the bottom plate is a relatively non-heat-conductive material such as wood or wood composite.

In all embodiments, the bottom plate is attached to the roof truss underneath the bottom chord of the roof truss. The bottom plate is attached to the interior partition walls which the roof truss intersects. Also, the bottom plate is attached to the roof truss in such a way that the bottom plate will not lift from the interior partition walls if the roof truss arches vertically. The connectors attaching the bottom plate to the roof truss may be prepositioned, removable, frangible or slidable.

Figure 5:
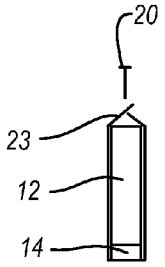
FIG. 5 is a longitudinal view of the bottom chord and bottom plate showing a wrap-around hanger.
Figure 6:
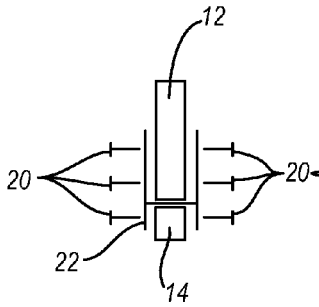
FIG. 6 is a longitudinal view of the bottom chord and bottom plate showing an H-shaped hanger.
Figure 7:
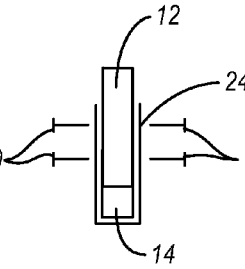
FIG. 7 is a longitudinal view of the bottom chord and bottom plate showing a U-shaped hanger with the U facing up.
Figure 8:
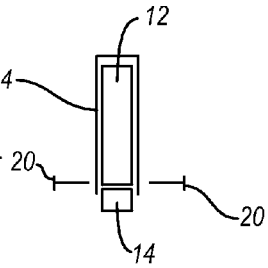
FIG. 8 is a longitudinal view of the bottom chord and bottom plate showing a U hanger with the U facing down.
Figure 14:
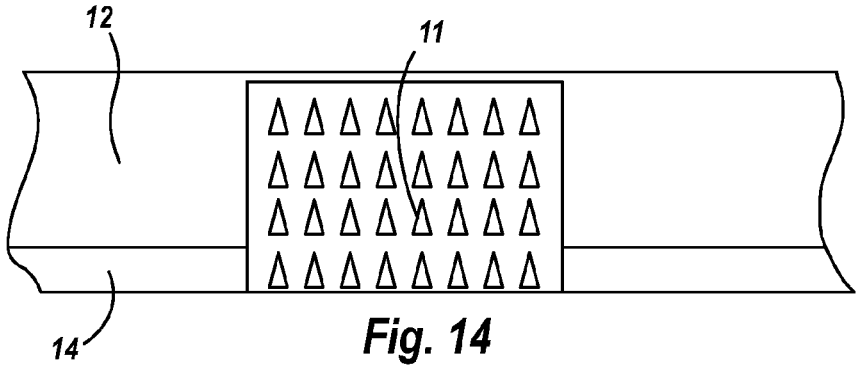
FIG. 14 is a detail view showing the bottom plate attached to the bottom chord with a gang plate.

An adequate number of connectors (16) are provided, spaced an appropriate distance apart, such that the bottom plate (14) and the relevant ceiling finish (30) are adequately supported by the roof truss (10). The connectors (16) may be any appropriate connector. In one embodiment the connectors are wood fasteners (20), such as nails, screws or other appropriate wood fasteners, which have been driven through the bottom plate (14) into the underside of the bottom chord (12). In another embodiment, shown in FIG. 14, the connectors are gang plates (17). Gang plates (17) are commonly used in the assembly of wood roof trusses to attach the various pieces of wood together. Gang plates (17) are metal sheets having pointed tangs protruding from one surface. In use, the gang plate (17) is positioned so as to overlap the joint between pieces of wood, and the pointed tangs are forced into the wood thus attaching the bottom plate to the bottom chord. In another embodiment the connectors (16) are comprised of hangers attached with wood fasteners (20). The hangers may be metal or nonmetal, and may be H-shaped hangers (22) as shown in FIG. 6, U-shaped hangers (24) as shown in FIGS. 7 and 8, wrap-around hangers (23) as shown in FIG. 5, or some other appropriate form of hanger. The wood fasteners (20) may be nails, screws, staples, or some other appropriate wood fastener.

The bottom plate (14) may be wood, wood composites, such as plywood or oriented strand board, or any other appropriate structural material.

In one embodiment, the connectors (16) are prepositioned so that when the roof trusses (10) are placed, the connectors (16) are in the correct position relative to the partition walls (27), wherein the connectors (16) are sufficiently distant from the partition walls (27) to ensure that vertical arching of the bottom chord (12) does not lift the bottom plate (14) from the partition walls top plates (28) and wherein the connectors (16) are sufficiently close to the partition walls (27) to adequately support the bottom plate (14) and ceiling finish (30).

In one embodiment, the connectors (16) are removable, wherein all or selected portions of the bottom plate (14) may be detached from the bottom chord (12). During installation of the roof truss (10), those connectors (16) which are too close to the partition wall (27) are removed. The connectors (16) may be removable in many different ways. In one embodiment, the wood fasteners (20) attaching the hangers to the bottom chord (12) or the bottom plate (14) can be removed, making it simple to remove the hangers.

Figure 15:
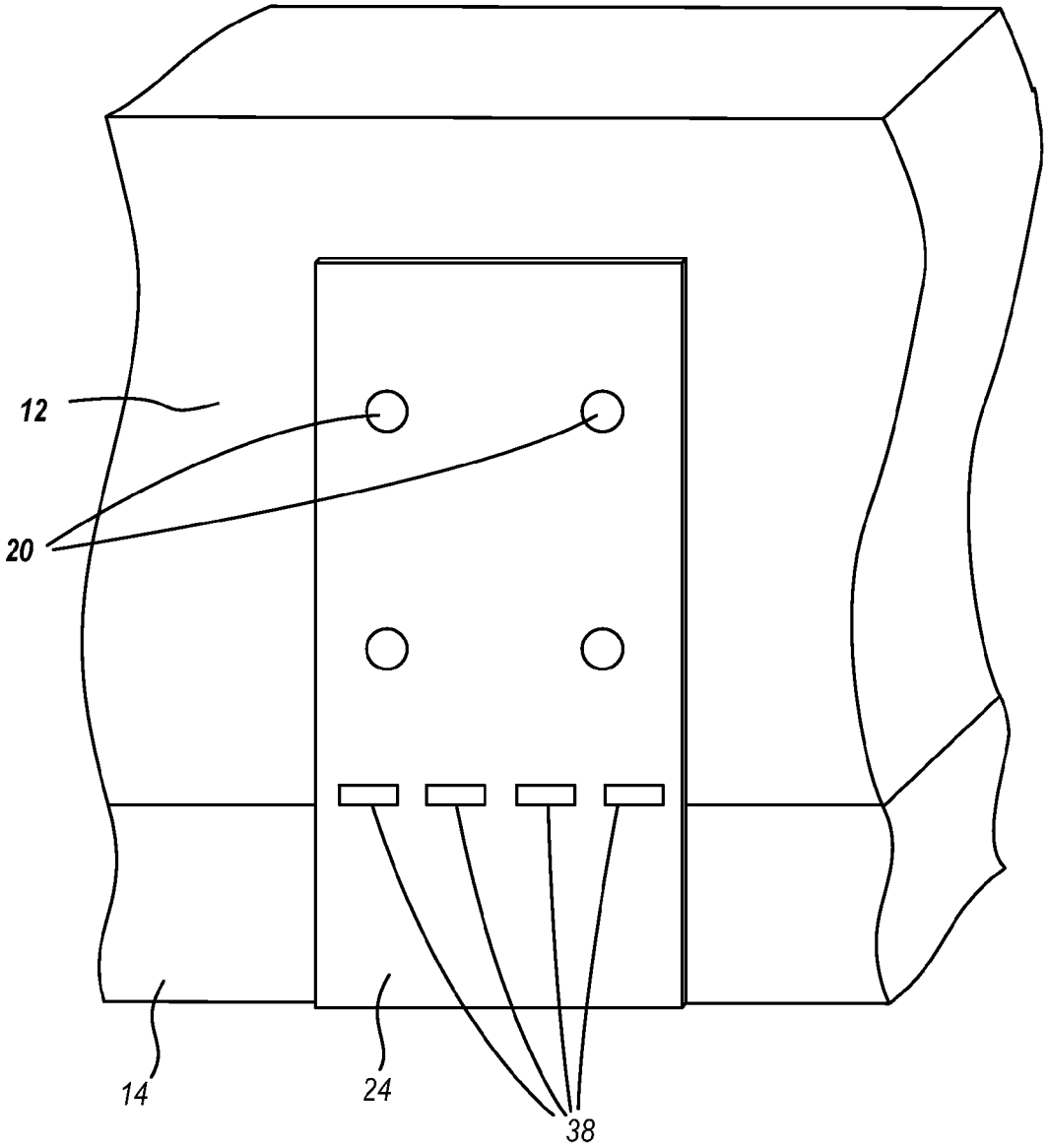
FIG. 15 is a detail view showing a U-shaped hanger with perforations.

In one embodiment the connectors (16) are frangible, in that they can be cut or broken so that all or selected portions of the bottom plate (14) may be detached from the bottom chord (12) by cutting or breaking the connectors (16). For example, the connectors (16) may be made frangible by rows of perforations across the connector which can be broken by prying with the claw of a claw hammer or a pry bar; or by using a hammer and chisel. FIG. 15 shows a U-shaped hanger (24) having such perforations (38).

Figure 9:
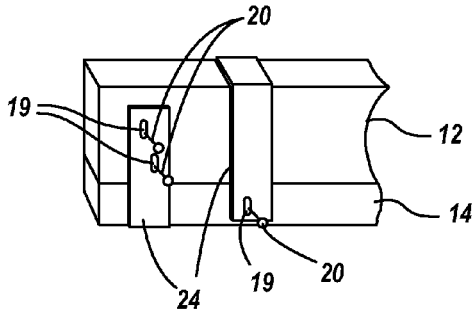
FIG. 9 is a perspective view of a section of the bottom chord and bottom plate showing two U hangers flexibly attaching the bottom plate to the bottom chord by means of slotted holes and fasteners.

In one embodiment the connectors (16) slidably attach the bottom plate (14) to the bottom chord (12) such that the bottom plate (14) may separate slightly from the bottom chord (12) yet remain attached by the connector (16). The connectors (16) can slidably attach the bottom plate (14) to the bottom chord (12) in many different ways. In one embodiment the hangers (18) are H-shaped hangers (22), U-shaped hangers (24) as shown in FIG. 9, or other appropriate hangers, with slotted holes (19). The wood fasteners (20) are driven through the slotted holes (19) into the bottom plate (14) and/or bottom chord (12) as shown in FIG. 9. Under sufficient tension, the slotted holes (19) permit the hangers to slide relative to the bottom plate (14), the bottom chord (12) or both.

Figure 10:
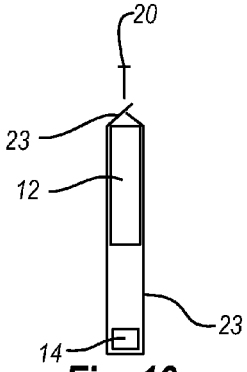
FIG. 10 is a longitudinal view of the bottom chord, bottom plate and a connector showing a thermal gap between the bottom chord and the bottom plate.
Figure 11:
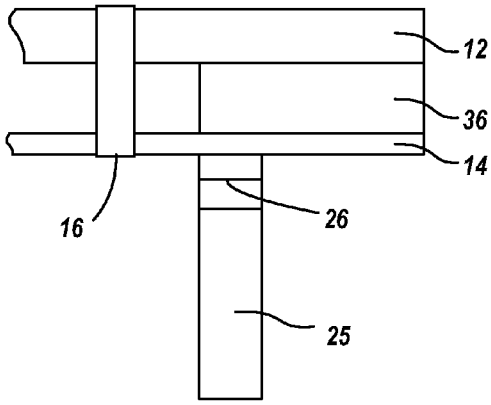
FIG. 11 is a detail view of the intersection of the roof truss and an exterior wall, showing a spacer, and the thermal gap between the bottom chord and the bottom plate.

In one embodiment, the bottom plate (14) and the bottom chord (12) are positioned so as to create a thermal gap between them as shown in FIGS. 10 and 11. This gap is defined by a spacer (36) between the bottom plate (14) and the bottom chord (12) at the point where the bottom plate (14) rests on the exterior wall (25). The connectors (16) are configured and positioned so as to substantially maintain the gap along the length of the bottom plate (14) and the bottom chord (12).

Figure 2:
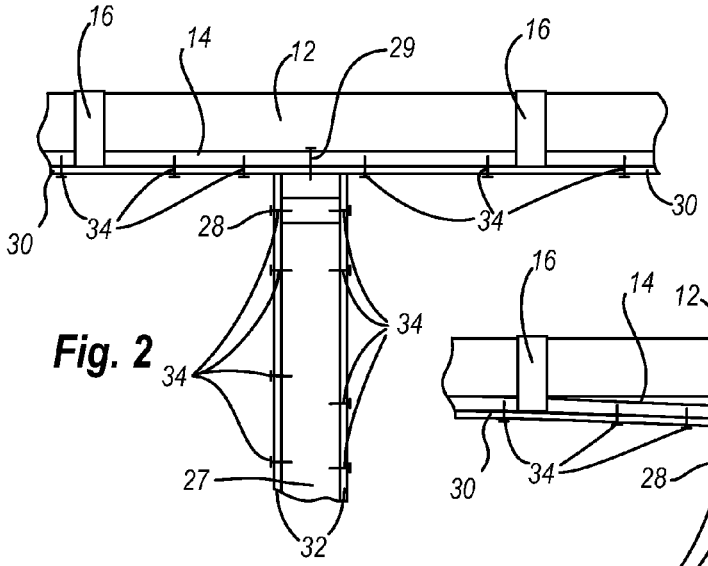
FIG. 2 is a detail view of the intersection of the improved roof truss and a partition wall before the roof truss has lifted.
Figure 3:
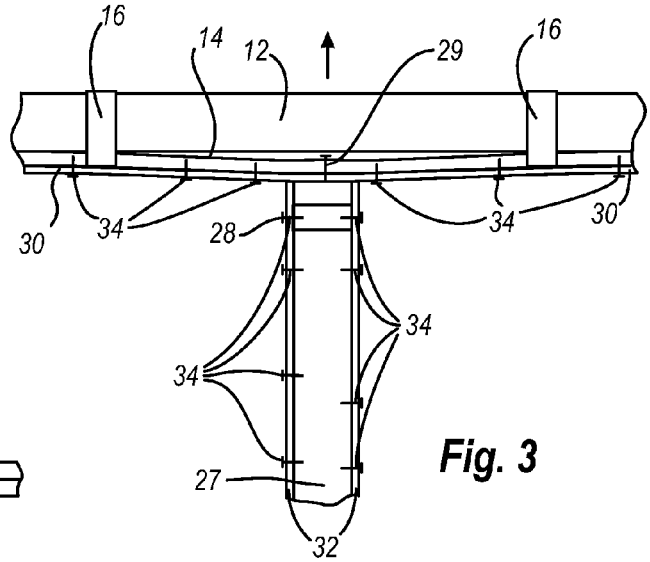
FIG. 3 is a detail view of the improved roof truss and a partition wall after the roof truss has lifted, exaggerating the flexing of the bottom plate and the ceiling finish.
Figure 4:
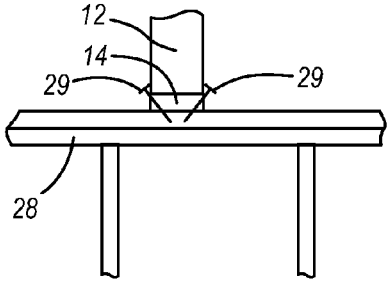
FIG. 4 is a longitudinal view of the bottom chord and bottom plate, and a cross sectional view of a partition wall showing fasteners attaching the bottom plate to the partition wall top plate.
Figure 12:
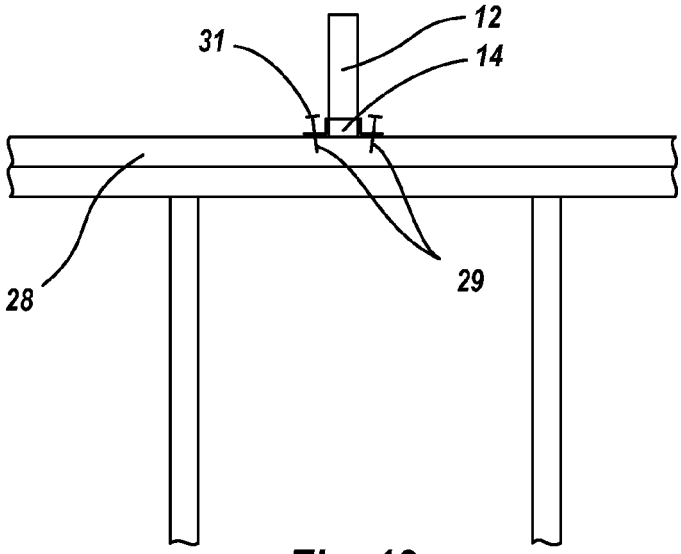
FIG. 12 is a longitudinal view of the bottom chord and bottom plate, and a cross sectional view of a partition wall showing a bracket and fasteners attaching the bottom plate to the partition wall top plate.
Figure 13:
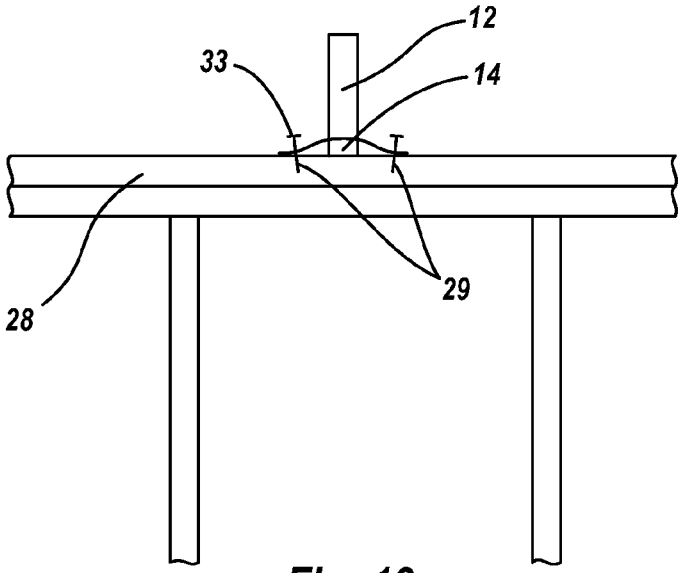
FIG. 13 is a longitudinal view of the bottom chord and bottom plate, and a cross sectional view of a partition wall showing straps and fasteners attaching the bottom plate to the partition wall top plate.

In use, the roof truss is generally positioned so as to rest upon the exterior and interior walls as shown in FIG. 1. The bottom plate (14) is attached to the exterior wall top plates (26) and the partition wall top plates (28) with fasteners (29) as shown in FIG. 4, brackets (31) as shown in FIG. 12, or straps (33) as shown in FIG. 13. The fasteners may be nails, screws or other appropriate fasteners. The brackets (31) may be metal or any other suitable material. The brackets (31) are prepositioned during the assembly of the roof truss (10). The straps (33) may be metal or any other suitable material. The straps (33) may be prepositioned during the assembly of the roof truss (10) or inserted between the bottom chord (12) and the bottom plate (14) on the construction site. The brackets (31) and straps (33) are fixed to the partition wall top plates with nails, screws or other appropriate fasteners. As shown in FIG. 2, the ceiling finish (30) is attached to the underside of the bottom plate (14) with appropriate finish fasteners (34), and the wall finish (32) is attached to the partition wall (27) with appropriate finish fasteners (34). If the bottom chord (12) arches upwards, away from the partition wall top plates (22), the portion of the bottom plate (14) and the ceiling finish (30) which are proximate to the partition wall top plates (22) flex so as to permit the portion of the bottom plate (14) in contact with the partition wall top plates (22) to remain in the same position relative to the partition wall top plates (22) and the wall finish (32), as shown in FIG. 3.

As will be apparent to a person skilled in the art, various modifications, adaptations and variations of the foregoing specific disclosure may be made without departing from the scope of the invention claimed below.

We claim:

1. An improved roof truss, comprising (a) a bottom chord;

(b) a bottom plate disposed underneath and substantially parallel to the bottom chord;

(c) means for attaching the bottom plate to the bottom chord;

(d) spacers disposed between the bottom plate and the bottom chord which create a thermal gap between the bottom plate and the bottom chord; and (e) a bracket positioned between the bottom plate and the bottom chord, located at the intersection of the bottom plate and an interior partition wall, having a horizontal planar member on the top of the bottom plate attached to vertical planar members on either side of the bottom plate which are attached to horizontal planar members extending away from the bottom plate along the top surface of the interior partition wall, wherein fasteners can be driven through the horizontal planar members extending away from the bottom plate along the top surface of the interior partition wall so as to attach the bottom plate to the interior partition wall.

2. The improved roof truss of claim 1 wherein the bracket is metal.

3. An improved roof truss comprising a bottom chord, a top chord and at least two intermediate members, wherein said bottom chord, said top chord and said at least one of said least two intermediate members are planar and create a generally planar triangular shape, wherein at least one of said at least two intermediate members is not perpendicular to said bottom chord, wherein said top chord and said bottom chord each define inside surfaces which generally face one another, and said intermediate members connect to and extend between said inside surfaces, wherein the improvement comprises:

(a) a bottom plate disposed underneath and substantially parallel to said bottom chord;

(b) means for attaching the bottom plate to said bottom chord; and (c) spacers disposed between said bottom plate and said bottom chord which create a thermal gap between said bottom plate and said bottom chord, and (d) a strap located at the intersection of the bottom plate and an interior partition wall, said strap passing between the bottom plate and the bottom chord, wherein said strap is adapted to be fastened to the interior partition wall wherein fasteners are driven through the planar member on either side of the bottom plate so as, to attach the bottom plate to the Interior partition wall.

4. The improved roof truss of claim 3 wherein the strap is metal.

* * * * *